United States Patent [19]

Mutschler et al.

[11] Patent Number: 4,645,367

[45] Date of Patent: Feb. 24, 1987

[54] WRITING IMPLEMENT VENTING SYSTEM

[76] Inventors: Otto Mutschler, Ludolf-Krehl-Strasse 21; Albert Menrath, Kehler Weg 6, both of D-6900 Heidelberg, Fed. Rep. of Germany

[21] Appl. No.: 657,600

[22] Filed: Oct. 4, 1984

[30] Foreign Application Priority Data

Oct. 21, 1983 [DE] Fed. Rep. of Germany ..... 3338227

[51] Int. Cl.[4] ..... B43K 8/02; B43K 7/08; B43K 5/18

[52] U.S. Cl. ..... 401/199; 401/225; 401/227

[58] Field of Search ..... 401/225, 227, 228, 229, 401/198, 199

[56] References Cited

U.S. PATENT DOCUMENTS

| | | | |
|---|---|---|---|
| 2,101,304 | 12/1937 | Wright | 401/227 |
| 2,158,615 | 5/1939 | Wright | 401/225 X |
| 3,087,464 | 4/1963 | Wittnebert et al. | 401/227 |
| 3,411,854 | 11/1968 | Rosler et al. | 401/227 |
| 3,521,969 | 7/1970 | Mutschler | 401/225 |
| 4,382,707 | 5/1983 | Anderka | 401/198 |

FOREIGN PATENT DOCUMENTS

| | | | |
|---|---|---|---|
| 3207219 | 10/1983 | Fed. Rep. of Germany | 401/198 |
| 1570203 | 6/1969 | France | 401/228 |
| 464497 | 7/1951 | Italy | 401/227 |
| 899475 | 6/1962 | United Kingdom | 401/227 |
| 941439 | 11/1963 | United Kingdom | 401/198 |

*Primary Examiner*—Steven A. Bratlie
*Attorney, Agent, or Firm*—Kurt Kelman

[57] ABSTRACT

A balanced ink feeding system comprises a lamellate body connected to a retaining member holding a writing element for feeding ink to the writing element, the retaining member with the lamellate body being fluid-tightly fastened in a housing sleeve by frictional engagement therewith. The lamellate balanced ink feeding system body includes a tubular member, two ink collecting chamber halves arranged on the tubular member, respective air inlet and outlet grooves conducting air to and from the two chamber halves, and a center air conducting groove between the air inlet groove and air outlet groove, the grooves extending parallel to each other, respective webs projecting from the tubular member for air-tight separating the air inlet and outlet grooves from the center groove, a flange on the tubular member for closing respective front ends of the air inlet and outlet grooves adjacent the writing element, respective rear ends of the air inlet and outlet grooves remote from the writing element being in communication with the center air conducting groove through a transverse groove, and the transverse groove being in communication with an ink flow control path, a capillary gap and an air passage groove.

5 Claims, 6 Drawing Figures

WRITING IMPLEMENT VENTING SYSTEM

The present invention relates to a writing implement comprising a writing element, such as a stylus, a pen point, a ball point or a filamentary point, a retaining member holding the writing element, a lamellate body providing a balanced ink feeding system connected to the retaining member for feeding ink to the writing element, and a housing sleeve encasing the same.

Lamellate bodies providing a balanced ink feeding system wherein the ink flow is in equilibrium are in use worldwide for fountain pens of all sorts. Almost all of these systems are responsive to temperature and air pressure variations because they have ink collecting chambers which may be easily filled. Air is generally conducted to and from these chambers through an air duct opposite to a capillary ink feeding duct. Once the chambers have been filled with ink, the system is no longer vibration- or impact-proof and, therefore, residual amounts of ink may ooze out of the air duct. This disadvantage is particularly aggravating to the user when such a writing implement has been been filled and "started" before it is transported to its point of destination. In this event, ink residues accumulate in the closure cap and may flood its sealing region. When the closure cap is then removed, ink will frequently emerge from the cap and soil the fingers or clothing of the user.

It is accordingly a primary object of this invention to overcome this disadvantage and to arrange the air inlet and outlet passages of the balanced ink feeding system so that it is vibration- and impact-proof whereby the writing implement may be safely dispatched by air transport, for example.

The above and other objects are accomplished according to the invention with a lamellate body fluid-tightly fastened in the housing sleeve by frictional engagement therewith. The lamellate balanced ink feeding system body includes a tubular member, two ink collecting chamber halves arranged on the tubular member, respective air inlet and outlet grooves conducting air to and from the two chamber halves, and a center air conducting groove between the air inlet groove and air outlet groove, the grooves extending parallel to each other, respective webs projecting from the tubular member for air-tightly separating the air inlet and outlet grooves from the center groove, a flange on the tubular member for closing respective front ends of the air inlet and outlet grooves adjacent the writing element, respective rear ends of the air inlet and outlet grooves remote from the writing element being in communication with the center air conducting groove through a transverse groove, and the transverse groove being in communication with an ink flow control path, a capillary gap and an air passage groove.

Figure 1:
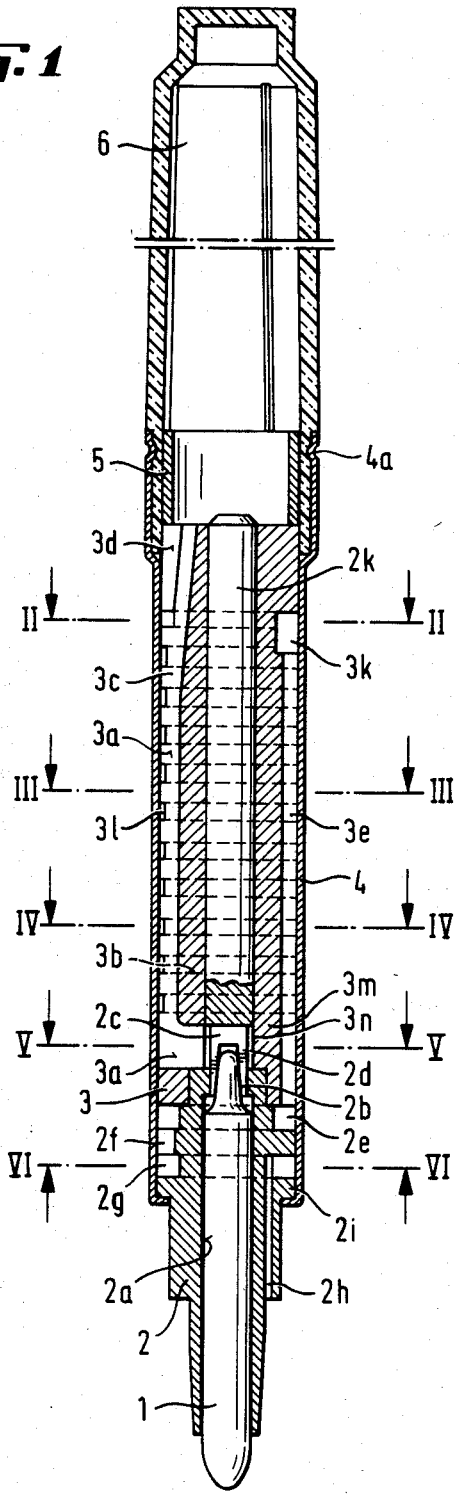
Figure 2:
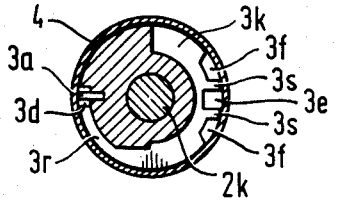
Figure 3:
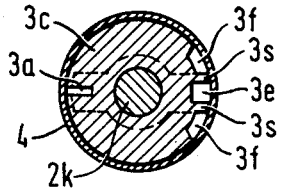
Figure 4:
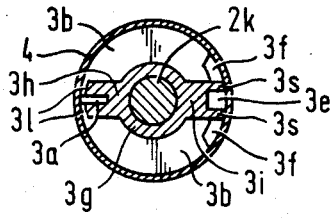
Figure 5:
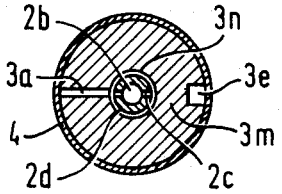
Figure 6:
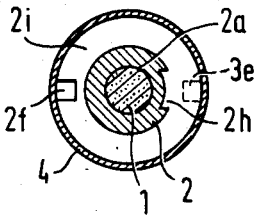

The above and other objects, advantages and features of the present invention will become more apparent from the following detailed description of a now preferred embodiment thereof, taken in conjunction with the drawing wherein FIG. 1 shows an axial section of a writing implement incorporating the lamellate balanced ink feeding system body; and FIGS. 2 to 6 show respective transverse cross sections along lines II—II, III—III, IV—IV, V—V and VI—VI, respectively, of FIG. 1.

Referring now to the drawing, the writing implement is shown to comprise writing element 1, retaining member 2 holding the writing element, housing sleeve 4, and lamellate body 3 providing a balanced ink feeding system connected to retaining member 2 for feeding ink in equilibrium to the writing element. As shown in FIG. 1, retaining member 2 with lamellate body 3 is fluid-tightly fastened in housing sleeve 4 by frictional engagement therewith.

The lamellate balanced ink feeding system body includes tubular member **3*g* carrying, or integral with, lamellae 3*c* which are semi-annular discs integrally molded on the tubular member. Housing sleeve or barrel 4 fluid-tightly engages semi-annular discs 3*c* around their peripheries. Two ink collecting chamber halves 3*b* extend between the semi-annular discs on the tubular member. Longitudinally extending rib 3*i* is molded to tubular member 3*g* and projects radially therefrom, and two chordally extending webs 3*s* on rib 3*i* define longitudinally extending air conducting groove 3*e* therebetween. The rear end of center air conducting groove 3*e* remote from writing element 1 is in communication with transverse groove 3*k*. Air inlet and outlet grooves 3*f* are defined by aligned cut-outs in discs 3*c* adjacent rib 3*i* and extend parallel to center groove 3*e* for conducting air, respectively, to and from ink collecting chamber halves 3*b*. Flange 3*m* on tubular member 3*g* closes respective front ends of air inlet and outlet grooves 3*f* adjacent writing element 1. Respective rear ends of the air inlet and outlet grooves remote from writing element 1 are in communication with center air conducting groove 3*e* through transverse segmental groove 3*k* which is in communication with ink flow control path 3*r*, capillary gap 3*a* and air passage groove 3*d* connected to ink reservoir 6. Longitudinally extending capillary gap 3*a* is defined by longitudinal rib 3*h* projecting radially from tubular member 3*g*. Ink collecting chamber halves 3*b* are in communication with longitudinally extending capillary gap 3*a* by two capillary transverse gaps 31. Diagonally extending ribs 3*h* and 3*i* divide the ink collecting chamber into two halves 3*b***.

In the illustrated embodiment, retaining member 2 carries axially extending plug-on pin **2*k* and lamellate body 3 defines bore 3*n*. Pin 2*k* frictionally engages bore 3*n*** whereby the lamellate balanced ink feeding system body can be plugged on and fastened to the pin.

The writing implement comprises ink reservoir 6. Retaining member 2 defines air shaft **2*h*, which is in communication with the atmosphere, two annular air conducting grooves 2*e* and 2*g*, and longitudinal air conducting groove 2*f* connecting the two annular air conducting grooves 2*e*, 2*g*, the air entering shaft 2*h* from the atmosphere and being conducted to annular groove 2*g* in communication with the air shaft, whence it flows through groove 2*f* into groove 2*e* which is in communication with center air conducting groove 3*e*. In this manner, air conducting grooves 2*e*, 2*f*, 2*g* are in communication through center air conducting groove 3*e* and transverse groove 3*k* with air outlet groove 3*f*, on the one hand, and through ink flow control path 3*r* and air passage groove 3*d* with ink reservoir 6, on the other hand. The retaining member has flange 2*i* engaging shoulder 4*b* of barrel 4**.

Plug-on pin **2*k* defines conical bore 2*b* in reduced-diameter front end 21 of pin 2*k* and the rear end of writing element 1 is plugged into conical bore 2*b* and in communication with ink reservoir 6 through this conical bore, capillary longitudinal gap 2*c*, annular capillary gap 2*d* and capillary gap 3*a*. Retaining member 2 defines axial bore 2*a* holding writing element 1 in a friction-fit and gap 2c extends from the rear end of axial bore 2a to annular gap 2d defined by plug-on pin front end 21 in the front end of bore 3n of lamellate body 3. Capillary gap 3a connects annular gap 2d to ink reservoir 6**.

When the writing implement is used, ink flows from ink reservoir 6 to writing element 1 through longitudinally extending capillary 3a defined in rib 3h on tubular member 3g into annular capillary 2d whence it passes through longitudinal capillary 2c to the rear end of writing element 1 so that ink is dependably supplied to the writing element in a steady flow.

In case of excess pressure in ink reservoir 6, due to elevated temperatures or a pressure drop in the ambient atmosphere (which may occur during air transport), this excess pressure is rapidly and dependably dissipated by the inflow of ink into the two ink collecting chamber halves 3b through transverse capillary 31 so that no ink will drip from the tip of writing element 1. Experiments have shown that the ink collecting chambers located closest to writing element 1 will be filled with writing fluid first. This is the reason why the front region of the air conducting groove close to the writing element is flooded with ink if the ink collecting chamber halves receive air and are vented by a common air conducting groove located at the bottom, without the capacity of the lamellate body being fully utilized. An air conducting groove filled with ink does not provide a vibration- or impact-proof ink seal so that such a writing implement cannot be safely shipped. This disadvantage is overcome according to the invention with the hereinabove described air conducting system wherein parallel air inlet and outlet grooves 3f are fluid-tightly separated by center air conducting groove 3e. As ink collecting chamber halves 3b are filled with ink, grooves 3f vent the chamber halves rearwardly, which enables ink to flow into all chambers without accidentally filling center air conducting groove 3e with ink. Only after both ink collecting chamber halves 3b have been filled with ink up to the level of transverse groove 3k at the rear of lamellate body 3 close to the ink reservoir can ink flow into center air conducting groove 3e through groove 3k. As shown in the drawing, the vibration resistance of the writing implement may be further enhanced even when center air conducting groove 3e is filled with ink by providing baffle walls at the front of retaining member 2, which may be accomplished by suitably forming grooves 2e and 2f.

When the pressure in the balanced ink feeding system is relieved either by using up ink by writing or a pressure drop in ink reservoir 6, the ink is sucked out first from grooves 3f, 3e and then from ink collecting chambers 3b. After these grooves and chambers have been emptied, ink flow control path 3r opens and permits air to flow into the ink reservoir until a pressure equilibrium has been established between the storage reservoir and the ambient atmosphere whereby ink flows in the required quantity from the ink reservoir to the writing element. As soon as the writing process has been completed, the ink closes the control path and, therefore, prevents dripping from the tip of writing element 1.

As shown in FIG. 1, housing sleeve or barrel 4 defines an enlarged bore at a rear end thereof remote from writing element 1 and ink reservoir 6 is received in the enlarged housing sleeve bore in a friction-fit. The ink reservoir is held fluid-tightly in the enlarged bore between support ring 5 and bead 4a radially inwardly projecting from the housing sleeve into the bore to grip the ink reservoir.

What is claimed is:

1. A writing implement comprising
(a) a writing element,
(b) a retaining member holding the writing element,
(c) a housing sleeve, and
(d) a lamellate body providing a balanced ink feeding system connected to the retaining member for feeding ink to the writing element, the retaining member with the lamellate body being fluid-tightly fastened in the housing sleeve by frictional engagement therewith and the lamellate balanced ink feeding system body including
(1) a tubular member,
(2) two ink collecting chamber halves arranged on the tubular member, respective air inlet and outlet grooves conducting air to and from the two chamber halves, and a center air conducting groove between the air inlet groove and air outlet groove, the grooves extending parallel to each other,
(3) respective webs projecting from the tubular member for air-tightly separating the air inlet and outlet grooves from the center groove,
(4) a flange on the tubular member for closing respective front ends of the air inlet and outlet grooves adjacent the writing element,
(5) respective rear ends of the air inlet and outlet grooves remote from the writing element being in communication with the center air conducting groove through a transverse groove, and
(6) the transverse groove being in communication with an ink flow control path, a capillary gap and an air passage groove.

2. The writing implement of claim 1, wherein the retaining member carries a plug-on pin and the lamellate body defines a bore, the pin frictionally engaging the bore whereby the lamellate balanced ink feeding system body is fastened to the pin.

3. The writing implement of claim 1, further comprising an ink reservoir, the retaining member defining an air shaft, two annular air conducting grooves and a longitudinal air conducting groove connecting the two annular air conducting grooves, the air conducting grooves defined by the retaining member being in communication through the center air conducting groove and the transverse groove with the air outlet groove, on the one hand, and through the ink flow control path and the air passage groove with the ink reservoir, on the other hand.

4. The writing implement of claim 3, wherein a rear end of the writing element is in communication with the ink reservoir through a conical bore, a capillary longitudinal gap, an annular capillary gap and the first-named capillary gap.

5. The writing implement of claim 3, wherein the housing sleeve defines an enlarged bore at a rear end thereof remote from the writing element and the ink reservoir is received in the enlarged housing sleeve bore, and further comprising a support ring and a bead radially inwardly projecting from the housing sleeve into the bore, the ink reservoir being held fluid-tightly in the bore between the support ring and the bead.

* * * * *